US007622690B2

(12) United States Patent
Karaki et al.

(10) Patent No.: US 7,622,690 B2
(45) Date of Patent: Nov. 24, 2009

(54) MOVABLE CONTACT, SHEET HAVING MOVABLE CONTACT, AND SWITCH APPARATUS USING THE SAME

(75) Inventors: Minoru Karaki, Okayama (JP); Akira Kamie, Okayama (JP); Nobumasa Nakao, Okayama (JP)

(73) Assignee: Panasonic Corporation, Osaka (JP)

( * ) Notice: Subject to any disclaimer, the term of this patent is extended or adjusted under 35 U.S.C. 154(b) by 246 days.

(21) Appl. No.: 11/843,828

(22) Filed: Aug. 23, 2007

(65) Prior Publication Data

US 2008/0210534 A1 Sep. 4, 2008

(30) Foreign Application Priority Data

Nov. 9, 2006 (JP) ..... 2006-303626

(51) Int. Cl.
*H01H 5/30* (2006.01)

(52) U.S. Cl. ..... 200/406; 200/516

(58) Field of Classification Search ..... 200/406, 200/516

See application file for complete search history.

(56) References Cited

U.S. PATENT DOCUMENTS 4,254,309 A * 3/1981 Johnson ..... 200/5 A
4,916,275 A * 4/1990 Almond ..... 200/516
6,262,383 B1 * 7/2001 Nishikawa ..... 200/406
6,373,008 B1 * 4/2002 Saito et al. ..... 200/310
6,495,783 B2 * 12/2002 Rochon et al. ..... 200/406
6,563,068 B2 * 5/2003 Yamagata et al. ..... 200/406
7,157,650 B2 * 1/2007 Rochon ..... 200/1 B
7,301,113 B2 * 11/2007 Nishimura et al. ..... 200/406
7,399,937 B2 * 7/2008 Nishimura ..... 200/314
7,427,724 B2 * 9/2008 Rochon et al. ..... 200/406

FOREIGN PATENT DOCUMENTS

JP 2005-071783 3/2005

* cited by examiner

*Primary Examiner*—Michael A Friedhofer
(74) *Attorney, Agent, or Firm*—Pearne & Gordon LLP

(57) ABSTRACT

The invention relates to a movable contact used for a sheet having a movable contact for example used for an electronic device such as a mobile phone and provides a movable contact that realizes, even when having a smaller size, a required pressing force and a favorable click touch response. To realize this, a part surrounded by a conical circumferential edge in which a circular outer circumference edge when seen from the upper side has an inclined surface forms a spherical surface-like section that swells in an upward direction. Both ends of the circle having an identical distance to center line of the circle are straightly cut off. Then, parts at which these straight cut edges intersect with the circular edges are chamfered to have a circular arc to provide a movable contact having a substantially oval shape having circular arc corners.

4 Claims, 5 Drawing Sheets

MOVABLE CONTACT, SHEET HAVING MOVABLE CONTACT, AND SWITCH APPARATUS USING THE SAME

BACKGROUND OF THE INVENTION

1. Field of the Invention

The present invention relates to a movable contact used for a sheet having a movable contact for example used for an operation section of an electronic device such as a mobile phone, a sheet having the movable contact, and a switch apparatus using the movable contact and the sheet.

2. Background Art

In recent years, electronic devices such as mobile communication devices such as mobile phones have been developed to have a remarkably small size. Thus, a sheet having a movable contact, which is used to constitute a switch apparatus in an operation section in such an electronic device, also has been required to have a smaller size while maintaining a superior touch, and a long life.

With regards to a movable contact used for the conventional sheet having a movable contact as described above, those shown in FIG. 11 to FIG. 12 have been suggested. The movable contact will be described with reference to the drawings.

FIG. 11 is a cross-sectional view of a conventional movable contact. FIG. 12 is a plan view thereof.

As shown in FIG. 11 and FIG. 12, movable contact 1 has a substantially arch-like shape when viewed from the side in which the center protrudes upwardly and in which a long shape is obtained, when viewed from the top, by cutting upper and lower ends of an outer circular shape so that, the upper and lower ends are parallel to each other.

Movable contact 1 is prepared to have the above shape by sequentially subjecting an elastic thin metal plate to a punching machining by a press metal die and a bending machining.

When movable contact 1 is used, the center part is applied with a depression force and, when a predetermined depression force (also may be called as "pressing force") is exceeded, the center part elastically inverts to have a shape swelling to the lower side while causing a stepwise touch response (also may be called as "click, touch response"). When the depression force is reduced and is smaller than a predetermined depression force (recovery force), movable contact 1 uses the elastic restoring force to have an original shape while causing a click touch response.

In movable contact 1 having the above shape, upper and lower ends are cut from the outer circular shape so that the upper and lower ends are parallel to each other. Thus, movable contact 1 can be arranged with a higher arrangement efficiency.

With regards to information for a publication of related art for the invention of this application, Japanese Patent Unexamined Publication No. 2005-71783 is known for example.

However, although movable contact 1 of the conventional design has a high arrangement efficiency by the long shape as described above, movable contact 1 conventional design also has a disadvantage in that, when movable contact 1 itself is required to have an outer shape to satisfy requirements by smaller devices in recent, years and is set to have an excessively narrow width, a pressing force may be reduced to cause a weak click touch response, thus preventing movable contact 1 from being practically used.

SUMMARY OF THE INVENTION

It is an objective of the present invention to solve the problem of the conventional technique as described above. It is an objective of the present invention to provide a movable contact shaped to have a narrow width that provides a required pressing force and a favorable click touch response, a sheet having a movable contact, and a switch apparatus using the movable contact and the sheet having a movable contact.

In order to realize this, according to the present invention, in order to realize the so-called click rate ((P1−P2)/P1) showing a relation between pressing force (P1) and recovery force (P2) is at least 40% or more, an elastic thin plate metal having a spherical surface in which the lower side is opened is cut by cutting both ends symmetric to the center line of the circle when seen from the upper side by parallel straight lines and then parts at which, the cut straight edges and circular edges intersect are chamfered to have a circular arc surface, thereby providing a substantially oval shape. Preferably, rate (W/D) between outer diameter size (f D) of the circle and interval (W) between parallel straight, lines at which both ends are cut off is 62% or more, chamfering radius (R) is 0.8 to 1.2 mm, and the outer circumference in the longitudinal direction has an inclination angle of 8 degrees to 20 degrees.

By the above structure, a required pressing force is obtained by set width (W/D) and the inclination angle of the circular edge. Corners at which straight edges and circular edges intersect are chamfered to have a circular arc shape to form a substantially oval shape. As a result, a click touch response is improved. The above structure also can provide a favorable operation feeling in spite of the face that the structure has a smaller area and an improved arrangement efficiency to provide a stable behavior during the inversion operation (i.e., smaller width).

As described above, the present invention can provide a movable contact having a narrow width and a substantially oval shape while securing required pressing force and click touch response.

DETAILED DESCRIPTION OF THE INVENTION

Hereinafter, an embodiment of a movable contact, a sheet having a movable contact, and a switch apparatus using the movable contact and the sheet according to the present invention will be described with reference to FIG. 1 to FIG. 10.

Embodiment

Figure 1:
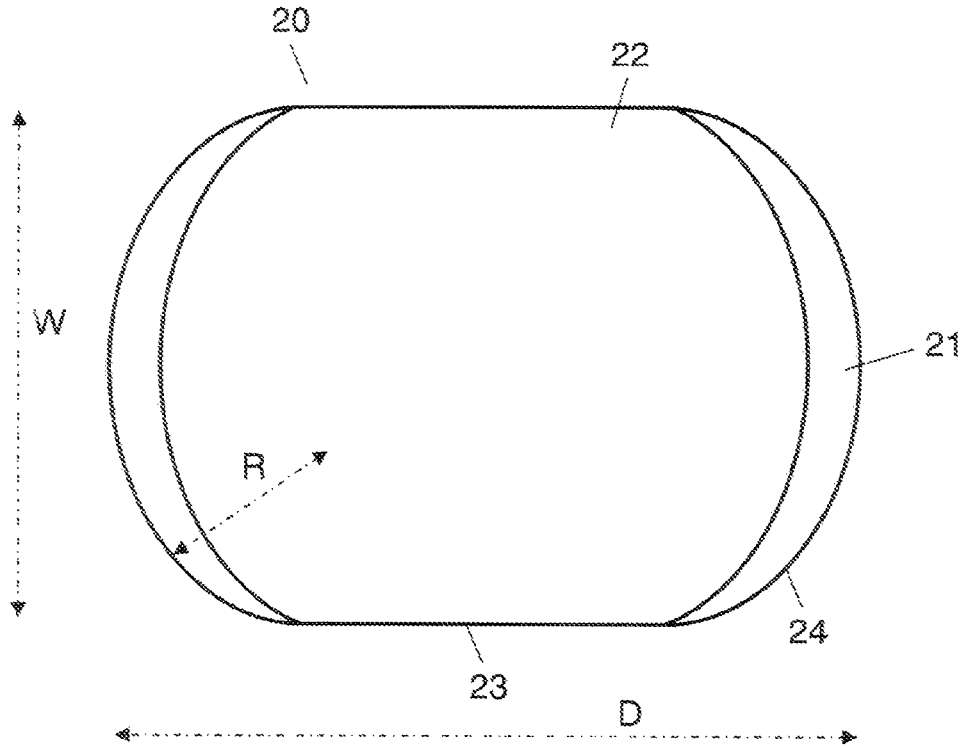
FIG. 1 is a plan view of a movable contact according to an embodiment of the present invention.
Figure 2:
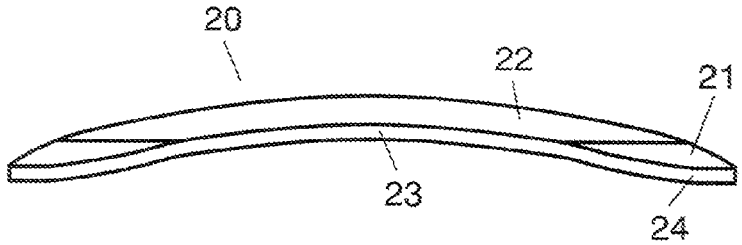
FIG. 2 is a side view of the movable contact.

FIG. 1 is a plan view illustrating a movable contact according to an embodiment of the present invention. FIG. 2 is a side view illustrating the movable contact.

As shown in FIG. 2, movable contact 20 made by an elastic thin plate metal is structured to have a substantially arch-like shape when viewed from the side in which the center upwardly protrudes. As shown in FIG. 1, movable contact 20 is designed so that upper and lower ends parallel to each other are cut by a straight line to have an equal distance from a horizontal center line of the circular shape when seen from the top. Four corners at which straight edge 23 cut off by this straight line intersect with circular edges seen from the top are chamfered to have a circular arc shape to form four circular arc corners 24 to provide a substantially oval shape (elongated circular shape or a race track shape).

At conical circumference edge 21 at which an outer circumference edge of the circular arc in the longitudinal direction of movable contact 20 forms an inclined surface when seen from the side, an intermediate part sandwiched by conical circumference edges 21 forms spherical surface-like section 22 that swells in an upward direction.

When movable contact 20 is used, a depression force is applied to an upper face of spherical surface-like section 22 and, when the depression force exceeds a predetermined pressing force, spherical surface-like section 22 elastically inverts to swell in the lower direction while causing a click touch response. Next, when the depression force is reduced and is smaller than a predetermined recovery force, movable contact 20 uses the elastic restoring force to have an original upwardly-swelling spherical surface while causing a click touch response.

The following section will describe so-called movable contact body 10 that is a sheet having a movable contact in which movable contacts 20 are maintained at predetermined positions at the lower face of an insulating film and an operation panel that is a switch apparatus using movable contact body 10.

Figure 3:
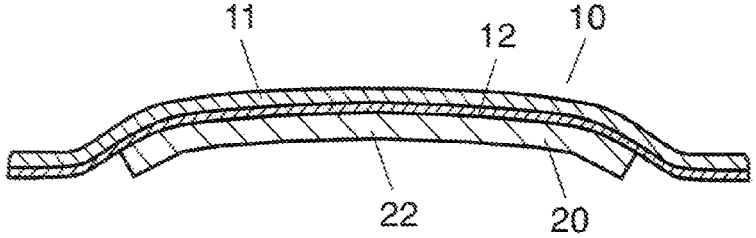
FIG. 3 is a cross-sectional view illustrating a movable contact body using the movable contact.
Figure 4:
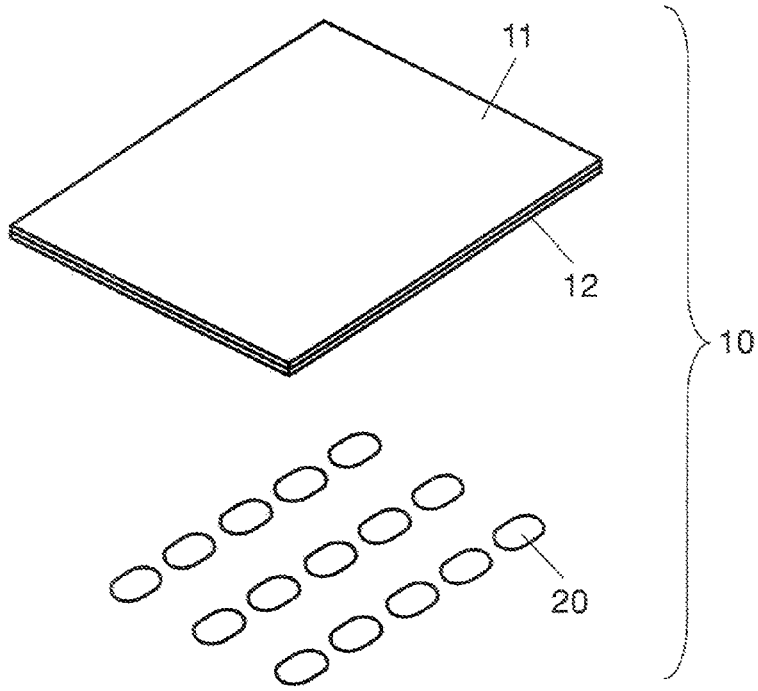
FIG. 4 is an exploded perspective view illustrating the movable contact body.
Figure 5:
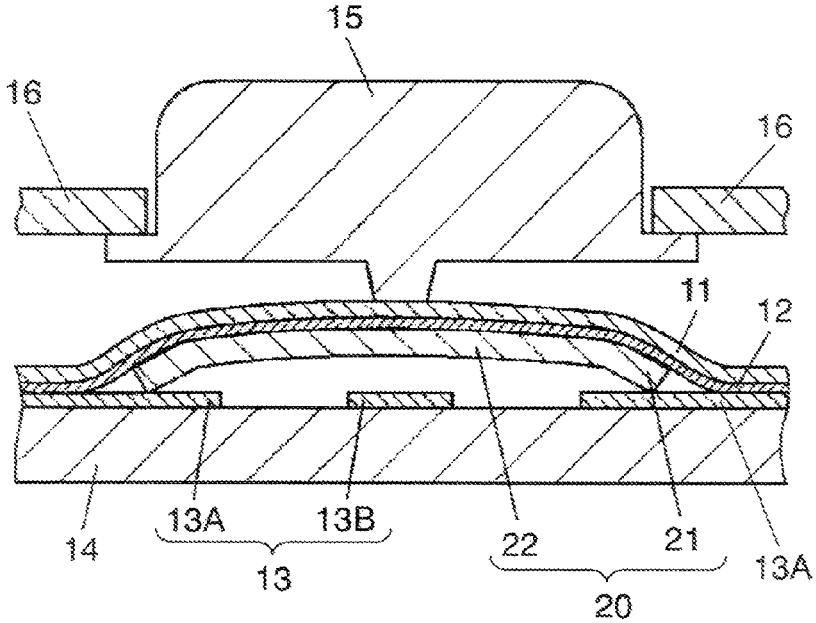
FIG. 5 is a cross-sectional view illustrating an operation panel using the movable contact body.

FIG. 3 is a cross-sectional view illustrating a movable contact body using the movable contact of this embodiment, FIG. 4 is an exploded perspective view of the movable contact body. FIG. 5 is a cross-sectional view illustrating an operation panel that is a switch apparatus using the movable contact body.

In the respective cross-sectional views, a cutting direction is a longitudinal direction of movable contact 20 and movable contact 20 is shown with a thickness that is relatively thicker than the actual one for easy understanding.

As shown in FIG. 3 and FIG. 4, movable contact body 10 is a sheet having a movable contact using the movable contact according to this embodiment. Movable contact, body 10 is obtained by separately adhering upper faces of spherical surface-like sections 22 of movable contacts 20 to insulating resin film-made base sheet 11 made of PET resin for example by adhesive layer 12 formed on the lower surface of base sheet 11 to have a predetermined pattern. However, only a part of one movable contact 20 is shown in FIG. 3.

FIG. 4 is an exploded perspective view illustrating a status prior to the adhesion of a plurality of (or fifteen) movable contacts 20 to adhesive layer 12 at the lower surface of base sheet 11.

As shown in FIG. 5, an upper face of wiring substrate 14 on which a pair of fixed contact points 13 (13A and 13B) are provided at predetermined positions is adhered with movable contacts 20 of movable contact body 10 so that movable contacts 20 correspond to the positions of the pair of fixed contact points 13 (13A and 13B) by adhesive layer 12 at the lower face of base sheet 11. However, only a part of one movable contact 20 is shown in FIG. 5.

Then, lower ends of conical circumference edge 21 having a circular arc in the longitudinal direction of movable contact 20 always have a contact with fixed contact points 13A and the center of spherical surface-like section 22 is opposed to fixed contact point 13B to have an interval therebetween. Thus, movable contacts 20 and the pairs of fixed contact points 13 (13A and 13B) provide a plurality of separate switches, thereby providing an operation panel as a switch apparatus.

Operation button 15 of the electronic device is arranged so that, while operation button 15 of the electronic device being abutted to case cover 16 of the electronic device, operation button 15 of the electronic device is provided so as to be movable in upward and lower directions at an upper position corresponding to spherical surface-like section 22 at the center of movable contact 20. When operation button 15 is depressed by a finger for example, the force is applied to spherical surface-like section 22 of movable contact 20 via base sheet 11. When the depression force exceeds a predetermined magnitude, spherical surface-like section 22 elastically inverts to have a contact with fixed contact point 13B opposed to spherical surface-like section 22 and fixed contact points 13 (13A and 13B) are electrically connected via movable contact 20. Next, when the depression force for operating operation button 15 is removed, movable contact 20 itself returns to have an original shape to return to a normal status shown in FIG. 5 in which a part between fixed contact points 13 (13A and 13B) is in an OFF status.

When the structure as described above is used in which movable contact 20 is used as movable contact body 10, a space between movable contacts 20 can be reduced. Thus, the electronic device can have a smaller size, a space between movable contacts 20 can have an increased number of wiring routes of wiring substrate, and the electronic device can have an increased freedom degree in a circuit design.

Although not shown, a single switch having a narrow width also may be used in which, a base body in which an inner bottom face of an opening of the upper face includes a pair of fixed contact points is structured so that the opening accommodates movable contacts 20 so as to realize a contact or separation of fixed contact points and the opening is sealed by a flexible cover member. Alternatively, a single switch having a narrow width also may be used in which an operation member is placed on movable contact 20 so that the operation member can be depressed and operated and the opening is sealed by a cover member. The above structures are also preferably provided so that a lower end of conical circumference edge 21 of movable contact 20 is always placed on one fixed contact point because this structure provides an easy earthing.

Next, the following section will describe, with regards to movable contact 20 used for various switch embodiments as described above, the evaluation result of a rate (W/D) (hereinafter referred to as "side width rate") between an outer diameter size (diameter) (f D) of a circular edge of movable contact 20 when seen from the upper face and an interval (W) between parallel lines obtained by cutting the upper and lower ends of the circle, radius size (R) of a chamfered circular arc of circular arc corner 24 (hereinafter referred to as "circular arc size"), and an influence on a pressing force and a click touch response by inclination angle (θ) of conical circumference edge 21 obtained by machining the outer circumference edge to have an inclined surface when viewed from the side. In the evaluation, evaluation samples of elastic thin plate metals were prepared by a stainless steel strip SUS301 for a JIS G 4313 spring having a thickness of 0.065 mm and an outer diameter size (f D) of f 5 mm.

First, movable contacts 20 as evaluation samples were prepared to have a side width, rate (W/D) in a range from 52% to 78%, inclination angle (θ) of conical circumference edge 21 in a range from 5 degrees to 27 degrees, and circular arc size (R) in a range of 0.2 mm to 1.3 mm.

Then, these movable contacts 20 were depressed by a push stick of an aluminum-made cylindrical column of f 1.5 mm to check the pressing force and the click touch response. Specifically, the center part of spherical surface-like section 22 of movable contact 20 was depressed by an end of the push stick of f 1.5 mm to check the depression force (pressing force) during the elastic inversion and the depression force (recovery force) when the depression is gradually cancelled and the an original shape was returned by an elastic force. The click touch response was evaluated based on a click rate (((P1−P2)/P1)×100%) that was a value obtained by dividing, by pressing force (P1), a value (P1−P2) obtained by deducting recovery force (P2) from pressing force (P1) pressing force (P1).

Figure 6:
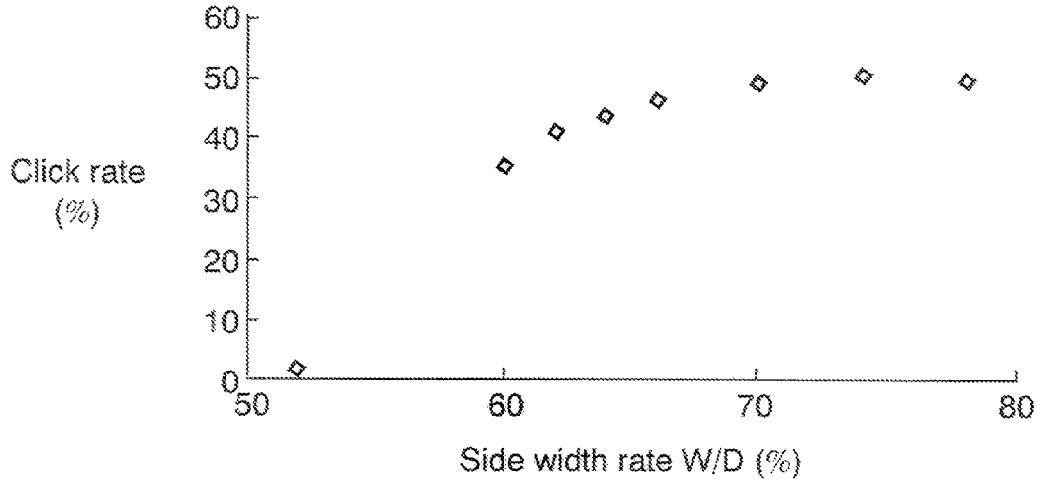
FIG. 6 shows a relation between side width rate (W/D) and a click rate when inclination angle (θ) is 15 degrees and circular arc size (R) is 0.9 mm.
Figure 7:
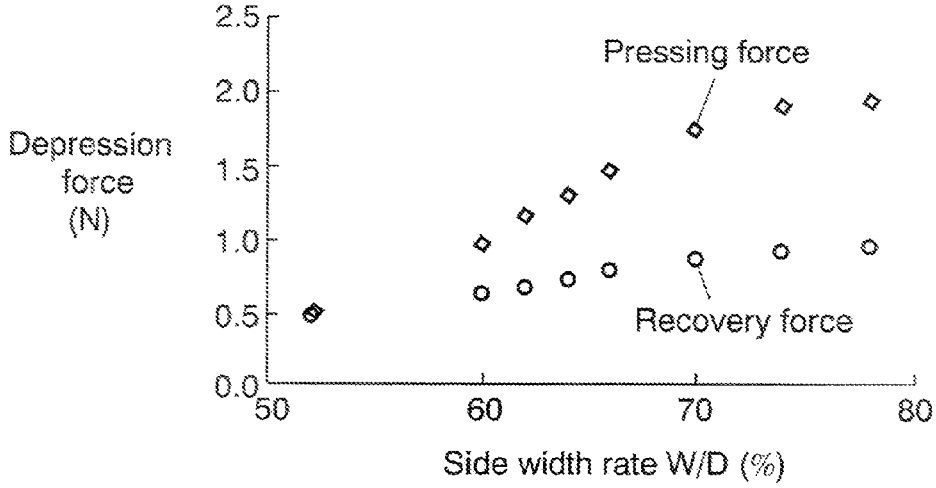
FIG. 7 shows a relation between side width rate (W/D) and a depression force under the same conditions as those of FIG. 6.

FIG. 6 shows a relation between side width rate (W/D) and a click rate when inclination angle (θ) is 15 degrees and circular arc size (R) is 0.9 mm. FIG. 7 shows a relation between side width rate (W/D) and depression force (unit: newton (N)) under the same conditions as those of FIG. 6.

Figure 8:
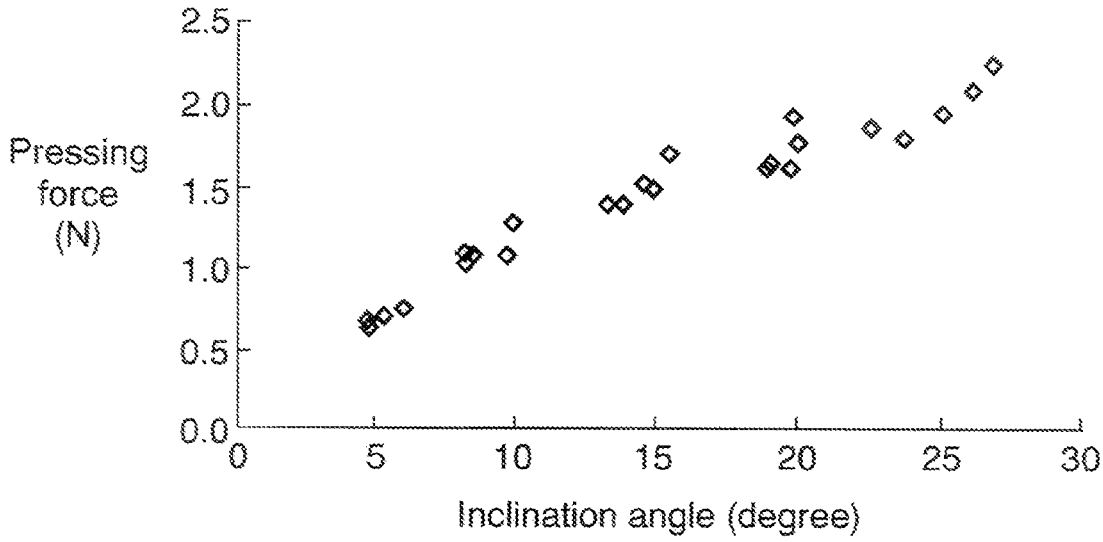
FIG. 8 shows a relation between inclination angle (θ) and a pressing force when side width rate (W/D) is 65% and circular arc size (R) is 0.9 mm.
Figure 9:
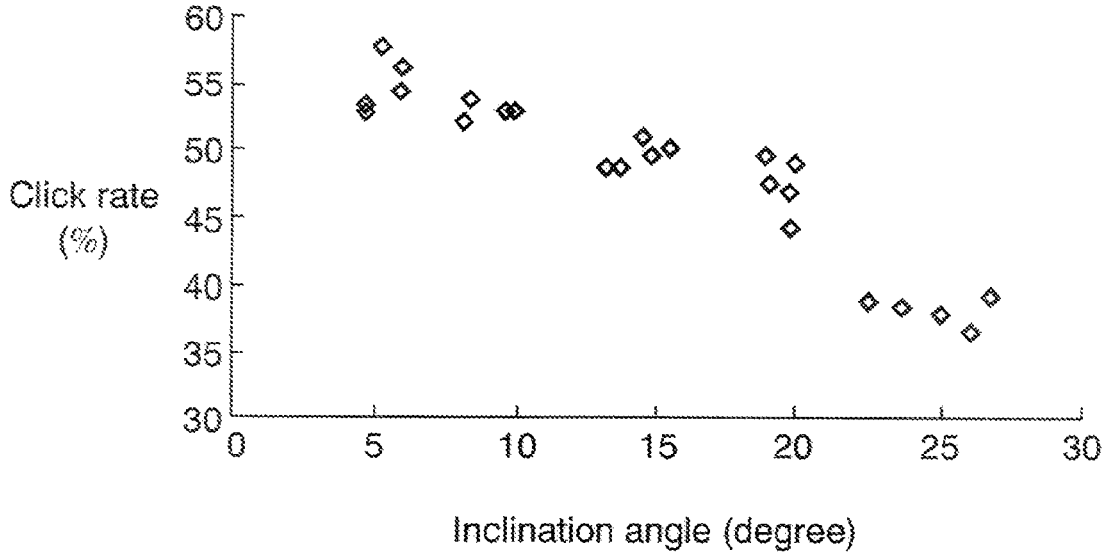
FIG. 9 shows a relation between inclination angle (θ) of and a click rate under the same conditions as those of FIG. 8.

FIG. 8 shows a relation, between inclination angle (θ) and pressing force (P1: unit N) when side width rate (W/D) is 65% and circular arc size (R) is 0.9 mm. FIG. 9 shows a relation between inclination angle (θ) of conical circumference edge 21 and a click rate under the same conditions as those of FIG. 8.

Figure 10:
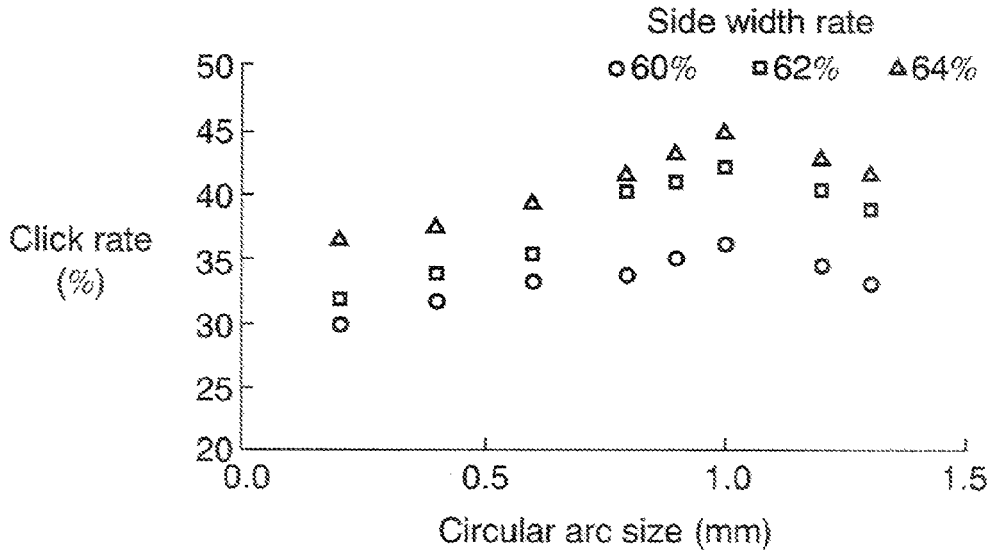
FIG. 10 shows a relation between circular arc size (R) and click rate when inclination angle (θ) and 15 degrees and side width rates (W/D) is varied.
Figure 11:
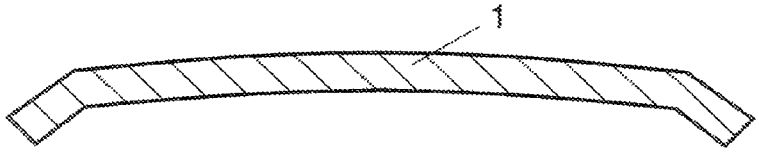
FIG. 11 is a cross-sectional view illustrating a conventional movable contact.
Figure 12:
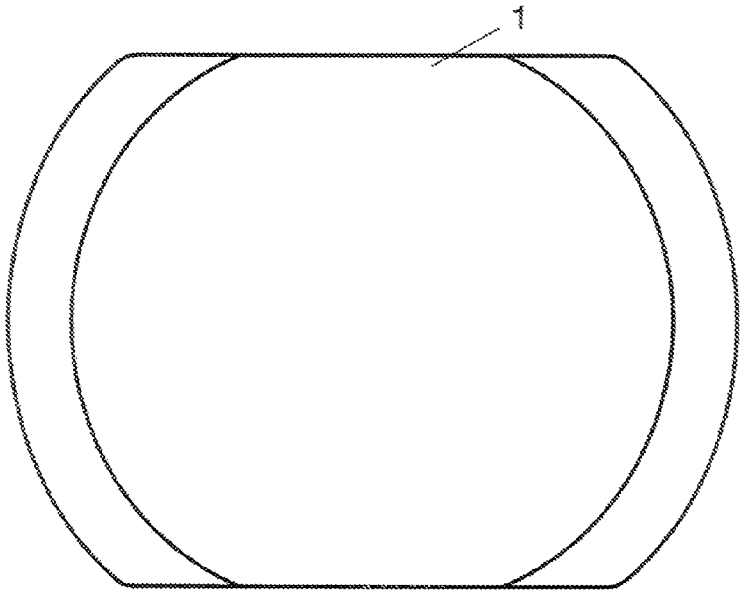
FIG. 12 is a plan view illustrating a conventional movable contact.

FIG. 10 shows a relation between circular arc size (R) and click rate when inclination angle (θ) and 15 degrees and side width rate (W/D) is 60%, 62%, and 64%.

As shown in FIG. 6, when side width rate (W/D) is 62% or more, the click rate of 40% or more is obtained and, when width rate (W/D) is 70% or more, the click rate of substantially 50% is stably obtained. However, side width rate (W/D) lower than 62% causes the click rate to be dramatically smaller than 40% to cause a dull and unclear click touch response.

The above result is caused by, as shown in FIG. 7, a decrease of side width rate (W/D) and a linear decrease of pressing force (P1) and recovery force (P2) and recovery force (P2) decreases with a higher rate to reduce a difference between pressing force (P1) and recovery force (P2) to reduce the click, rate, thus causing a dull click touch response.

This click rate can provide a favorable click touch response when side width rate (W/D) is 40% or more. However, when a difference between a pressing force and a recovery force is small, a stepwise feeling is reduced to cause an unclear click touch response, which is not preferred in practical use. When side width rate (W/D) exceeds 65% on the other hand, a difference between pressing force (P1) and recovery force (P2) is increased on the contrary. Thus, a strong stepwise feeling is obtained in this case but a user may feel that the elastic recovery of movable contact 20 is delayed when the user quickly changes a depressing operation to a depression cancelling operation, in other words, the user may feel that a click touch response has a poor followability to his or her operation of movable contact 20.

Thus, although a click rate of 40% or more provides a favorable click touch response, a click rate is preferably in a range of 40% to 65% when considering the above-described followability. A click rate within this range can provide a light click touch response as well as a favorable followability of movable contact 20 when a depression operation is quickly changed to a depression cancelling operation.

When movable contact 20 is installed in an electronic device, movable contact 20 is operated via an operation button. Thus, in order to secure an operation feeling, pressing force (P1) in a range of 1.5N to 2.0N has been mainly used and a pressing force of at least 1.0N or more has been used.

Thus, as is clear from FIG. 6 and FIG. 1, when inclination angle (θ) is 15 degrees and circular arc size (R) is 0.9 mm, movable contact 20 having pressing force (P1) of 1.0N or more and a click rate of 40% or more can be obtained by side width rate (W/D) of 62% or more. By securing this side width rate, required pressing force and click touch response can be secured and movable contact 20 having a narrow width and a substantially oval shape is obtained, thus providing a smaller size.

Next, when inclination angle (θ) of conical circumference edge 21 is changed as shown in FIG. 8, pressing force (P1) in proportion with inclination angle (θ) increases but inclination angle (θ) less than 8 degrees cannot secure a required pressing force of 1.0N or more. As shown in FIG. 9, inclination angle (θ) is in inverse proportion with a click rate and thus a click rate of 40% or more requires inclination angle (θ) of 20 degrees or less.

Specifically, when side width rate (W/D) is 65% and circular arc size (R) is 0.9 mm, required pressing force (P1) and click rate can be satisfied by inclination angle (θ) of 8 degrees to 20 degrees.

As shown in FIG. 10, all of the three samples having side width rates (W/D) of 60%, 62%, and 64% showed an increased click rate by providing circular arc size (R) of circular arc corner 24 with an appropriate size (about 1.0 mm).

A favorable click rate is obtained when side width rate (W/D) is higher (i.e., when a size of a part cut off from both ends of the oval shape is smaller and thus the oval shape is closer to an original outer circular shape (having a high side width rate). As can be seen from FIG. 10, all of the three samples having three different side width rates (W/D) show the highest click rate when circular arc size (R) is substantially 1.0 mm and a click rate decreases as the value moves away from 1.0 mm.

Based on this result, when an optimal narrow width is considered while securing a favorable click touch response, a sample having side width rate (W/D) of 60% shows the highest click rate of 36% and does not provide a favorable click touch response even when the sample is chamfered to have a circular arc surface.

With regards to the sample having side width rate (W/D) of 62% and showing a favorable result in FIG. 6, a 40% or more click rate could not be obtained unless the sample was chamfered to have a circular arc surface. The sample having side width rate (W/D) of 62% also showed a click rate of 40% or more when circular arc size (R) was within a range of 0.8 mm to 1.2 mm. It was thus found that a pressing force and a click rate required for the use were obtained to provide movable contact 20 having a substantially oval shape and having the narrowest width.

As can be seen from the result of FIG. 10, it is assumed that corners can be chamfered to have a circular arc surface having a predetermined size so as to provide a substantially oval shape to compensate a click rate that declines with the decrease of side width rate (W/D).

The tendency as described in detail was also found in other samples having outer diameter size (f D) other than f 5 mm (e.g., sample having outer diameter size (f D) of f 4 mm).

As described above, according to this embodiment, side width rate (W/D) that, is a rate between outer diameter size (f D) of the circle of a movable contact formed to have a narrow width and a substantially oval shape and interval (W) between parallel lines obtained by cutting both ends thereof can be 62% or more, the four corners have circular arc size (R) in a range of 0.8 mm to 1.2 mm, and the conical circumferential edge has inclination angle (θ) in a range of 8 degrees to 20 degrees. The structure as described above can easily realize a movable contact having a smaller size while securing required pressing force and click touch, response.

The movable contact of the present invention is advantageous in that a substantially oval movable contact having a narrow width can be obtained while securing required pressing force and click touch response. The movable contact, of the present invention is useful for a sheet having a movable contact used for an electronic device required to have a smaller and thinner size such as a mobile phone.

What is claimed is:

1. A movable contact made by an elastic thin plate metal, comprising:

a conical circumferential edge in which a outer circumference edge of the elastic thin plate metal having a circular shape when seen from the upper side has an inclined surface; and a spherical surface-like section in which a part surrounded by the conical circumferential edge swells in an upward direction, wherein:

when the spherical surface-like section is depressed, the spherical surface-like section elastically inverts while causing a stepwise feeling and, when the depression on the spherical surface-like section is cancelled, the spherical surface-like section elastically returns to have an original upwardly-swelling shape, both ends of the circular shape are cut by straight lines in parallel to each other to form two mutually symmetric straight edges having an identical distance to a center line of the circular shape, parts at which the cut straight edges intersect with the conical circumferential edge are chamfered to have a circular arc-shape to provide an oval shape or a race track-like shape, and a relation ((P1−P2)/P1) between depression force (P1) caused at the elastic inversion by the depression operation and depression force (P2) at the elastic recovery ((P1−P2)/P1) is set to be at least 40% or more.

2. The movable contact according to claim 1, wherein;

rate (W/D) between outer diameter size (f D) of the circular shape and interval (W) between the two straight edges is 62% or more; and the oval shape obtained by the chamfered circular arc parts has radius (R) of 0.8 to 1.2 mm, and the conical circumferential edge has an inclination angle in a range of 8 degrees to 20 degrees.

3. A sheet having a movable contact comprising:

a base sheet;

an adhesive layer formed at a lower face of the base sheet to have a predetermined pattern; and the movable contact according to any of claim 1 or 2 adhered and maintained by the adhesive layer.

4. A switch apparatus comprising:

a plurality of fixed contact points formed at an upper face of a wiring substrate; and the sheet having a movable contact according to claim 3, wherein:

the respective movable contacts included in the sheet having a movable contact are arranged to correspond to positions of the fixed contact points.

* * * * *